US005773202A

United States Patent [19]

Haye et al.

[11] Patent Number: 5,773,202

[45] **Date of Patent: *Jun. 30, 1998**

[54] METHOD FOR PROCESSING COLOR PHOTOGRAPHIC FILMS USING A PEROXIDE BLEACHING COMPOSITION

[76] Inventors: Shirleyanne Elizabeth Haye; Terrence Robert O'Toole; David Leroy Cole; John Michael Buchanan, all of Eastman Kodak Company, Rochester, N.Y. 14650

[ * ] Notice: The term of this patent shall not extend beyond the expiration date of Pat. No. 5,763,147.

[21] Appl. No.: 625,055

[22] Filed: Mar. 29, 1996

Related U.S. Application Data

[63] Continuation-in-part of Ser. No. 391,805, Feb. 21, 1995, abandoned.

[51] Int. Cl.[6] ..... G03C 5/44; G03C 5/12

[52] U.S. Cl. ..... 430/393; 430/430; 430/461; 430/943; 430/488; 430/491; 430/490; 430/493

[58] Field of Search ..... 430/393, 430, 430/461, 943, 488, 491, 490, 493

[56] References Cited

U.S. PATENT DOCUMENTS

| | | | |
|---|---|---|---|
| 3,839,045 | 10/1974 | Brown | 430/491 |
| 4,301,236 | 11/1981 | Idota et al. | 430/393 |
| 4,328,306 | 5/1982 | Idota | 430/393 |
| 4,737,450 | 4/1988 | Hall et al. | 430/393 |
| 5,318,880 | 6/1994 | English et al. | 430/430 |
| 5,324,624 | 6/1994 | Twist | 430/399 |
| 5,550,009 | 8/1996 | Haye et al. | 430/393 |
| 5,554,491 | 9/1996 | O'Toole et al. | 430/393 |
| 5,578,428 | 11/1996 | Fyson | 430/398 |
| 5,607,820 | 3/1997 | Nakamura | 430/393 |

FOREIGN PATENT DOCUMENTS

| | | | |
|---|---|---|---|
| 0 428 101 A1 | 5/1991 | European Pat. Off. . | |
| 0428101A1 | 5/1991 | European Pat. Off. | G03C 7/42 |
| 0678783 | 10/1995 | European Pat. Off. | G03C 7/42 |
| 0679945 | 11/1995 | European Pat. Off. | G03C 7/42 |
| 2373080 | 8/1978 | France | G03C 5/52 |
| 56-121035 | 9/1981 | Japan | G03C 5/44 |
| 2-153349 | 6/1990 | Japan | G03C 7/42 |
| 92/07300 | 4/1992 | WIPO | G03C 7/44 |
| 93/11459 | 6/1993 | WIPO | G03C 7/42 |

OTHER PUBLICATIONS

*Research Disclosure,* Jan., 1981, p. 6, No. 2011, by C.R. Coppel et al.

*Primary Examiner*—Mark F. Huff
*Attorney, Agent, or Firm*—J. Lanny Tucker

[57] ABSTRACT

A simple and effective bleaching method includes the use of a bleaching solution including a peroxide bleaching agent and chloride ion in an amount of at least 0.35 mol/l. An organic phosphonic acid or tertiary aminocarboxylic acid can also be present for stability. The method is useful for bleaching color photographic films containing at least 20 mol % silver bromide and from 0 to about 0.5 mol % silver iodide in at least one silver halide emulsion.

19 Claims, No Drawings

METHOD FOR PROCESSING COLOR PHOTOGRAPHIC FILMS USING A PEROXIDE BLEACHING COMPOSITION

RELATED APPLICATIONS

This application is a Continuation-in-Part of U.S. Ser. No. 08/391,805 filed Feb. 21, 1995 now abandoned.

Another related application is commonly assigned U.S. Ser. No. 08/625,181 filed on even date herewith by Haye, Bonner and Ballou and entitled "Method for processing High Silver Bromide Color Negative photographic Films Using A Peroxide Bleaching Composition."

FIELD OF THE INVENTION

The present invention relates generally to the processing of color photographic films, such as color motion picture print films. More particularly, it relates to the use of peroxide bleaching solutions comprising a certain amount of chloride ion to bleach such films.

BACKGROUND OF THE INVENTION

During processing of silver halide photographic elements, the developed silver is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions that are more compatible with the environment. Thus it is desirable to reduce or avoid the use of ferric complexes as bleaching agents.

Peracid bleaching solutions, such as those containing peroxide, persulfate, perborate, perphosphate, perhalogen, percarboxylic acid or percarbonate bleaching agents, offer an alternative to the ferric complex bleaching solutions. Some are less expensive and present lower chemical and biological demands on the environment since their by-products can be less harmful.

While persulfate bleaching agents have low environmental impact, they have the disadvantage that their bleaching activity is slow and thus require the presence of a bleaching accelerator. The most common bleaching accelerators are thiol compounds that have offensive odors.

Because hydrogen peroxide reacts and decomposes to form water, a peroxide based bleaching solution offers many environmental advantages over persulfate and ferric complex bleaching solutions. As a result, many publications describe peroxide bleaching solutions, including U.S. Pat. No. 4,277,556 (Koboshi et al), U.S. Pat. No. 4,301,236 (Idota et al), U.S. Pat. No. 4,454,224 (Brien et al), U.S. Pat. No. 4,717,649 (Hall et al) and WO-A-92/01972 (published Feb. 6, 1992).

In addition, WO-A-92/07300 (published Apr. 30, 1992) and EP 0 428 101 A1 (published May 22, 1991) describe peroxide compositions for bleaching high chloride silver halide emulsions (that is, silver halide emulsions having 80–100 mol % silver chloride, and predominantly 90 mol % silver chloride). These bleaching compositions comprise chloride ions at up to 0.4 mol/l of solution and have a pH in the range of 5 to 11. These particular bleaching solutions, however, purportedly fail to provide rapid and effective bleaching, requiring more than 60 seconds, unless the emulsions comprise nearly 100 mol % silver chloride.

Despite all of the efforts of researchers in the art, no peroxide bleaching composition has been commercialized because of various problems including vesiculation (that is, blistering of the photographic element from evolution of oxygen) and poor bleaching efficiency.

There remains a need, therefore, for highly efficient peroxide bleaching that does not suffer from the problems noted above. Moreover, it would be useful to bleach color photographic films having silver halide emulsions containing at least 20 mol % bromide in a rapid manner.

SUMMARY OF THE INVENTION

The noted problems are solved with a method for processing a color photographic element comprising:

bleaching an imagewise exposed and developed color photographic film containing a silver halide emulsion having at least 20 mol % silver bromide, and from 0 to about 0.5 mol % silver iodide, with a peroxide bleaching solution comprising:

a peroxide bleaching agent, and chloride ions present in an amount of at least 0.35 mol/l.

The method of this invention provides rapid and efficient bleaching of imagewise exposed and developed color photographic films, especially motion picture print films, containing silver halide emulsions containing at least 20 mol % silver bromide, and from 0 to about 0.5 mol % silver iodide, and avoids the problems noted above with known peroxide bleaching solutions. Vesiculation is easily controlled with the practice of the present invention. Moreover, the bleaching solutions used in this invention present little environmental harm.

These advantages are achieved by using a peroxide bleaching solution that contains chloride ion in an amount of at least 0.35 mol/l of solution. In preferred embodiments, the solution also contains an organic phosphonic acid or a tertiary aminocarboxylic acid, or a salt thereof to increase stability.

DETAILED DESCRIPTION OF THE INVENTION

Peroxide bleaching solutions useful in this invention contain a conventional peroxide bleaching agent including, but not limited to hydrogen peroxide, alkali and alkaline earth salts of peroxide, or a compound which releases or generates hydrogen peroxide. Such hydrogen peroxide precursors are well known in the art, and include for example, perborate, percarbonate, and hydrogen peroxide urea. In addition, hydrogen peroxide can be generated on site by electrolysis of aqueous solutions. Examples of peroxide bleaching solutions are described, for example, in *Research Disclosure*, publication 36544, pages 501–541 (September 1994). *Research Disclosure* is a publication of Kenneth Mason publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". Hydrogen peroxide is a preferred bleaching agent.

The amount of hydrogen peroxide (or its precursor) is generally at least 0.15 mol/l, and from about 0.15 to about 1 mol/l is preferred, and from about 0.35 to about 0.6 mol/l is more preferred. The optimum amount will depend upon the particular photographic film being processed.

Chloride ions can be supplied to the bleaching solution as part of a simple inorganic salt, such as an ammonium or alkali metal ion salt (for example, sodium chloride, potassium chloride, lithium chloride and ammonium chloride). In addition, they can be supplied as organic complexes such as tetraalkylammonium chlorides. Preferred salts are sodium chloride and potassium chloride.

The chloride ion concentration is at least 0.35 mol/l, with from 0.35 to about 1 mol/l being preferred, and from 0.35 to about 0.5 mol/l being most preferred. At higher peroxide concentrations and/or pH, higher chloride ion levels, such as from about 0.5 to about 1 mol/l, may be more preferred.

The bleaching solutions useful in this invention are quite simple, having only two essential components, the peroxide bleaching agent and chloride ions. Other optional and preferred components include a buffer, and an organic phosphonic acid or a tertiary aminocarboxylic acid, both of which are defined below.

Moreover, the bleaching solution is alkaline, having a pH within the general range of from about 8 to about 12, with a pH of from about 9 to about 11 being preferred, and a pH of from about 9.5 to about 10.5 being most preferred. The pH can be provided by adding a conventional weak or strong base, and can be maintained by the presence of one or more suitable buffers including, but not limited to, sodium carbonate, potassium carbonate, sodium borate, potassium borate, sodium phosphate, calcium hydroxide, sodium silicate, β-alaninediacetic acid, arginine, asparagine, ethylenediamine, ethylenediaminetetraacetic acid, ethylenediaminedisuccinic acid, glycine, histidine, imidazole, isoleucine, leucine, methyliminodiacetic acid, nicotine, nitrilotriacetic acid, piperidine, proline, purine and pyrrolidine. Sodium carbonate and potassium carbonate are preferred.

The amount of useful buffer or base would be readily apparent to one skilled in the art.

The bleaching solution preferably comprises one or more organic phosphonic acids or salts thereof. Generally such compounds are represented by the structure (I):

$$R_1N(CH_2PO_3M_2)_2$$

or (II):

$$R_2R_3C(PO_3M_2)_2$$

wherein $R_1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, β-phenethyl, o-acetamidobenzyl or β-phenethyl), a substituted or unsubstituted alkylaminoalkylene group (wherein the alkyl and alkylene has 1 to 12 carbon atoms, such as methylaminomethylene or ethylaminoethylene), a substituted or unsubstituted alkoxyalkyl group of 1 to 12 carbon atoms (such as methoxymethyl, methoxyethyl, propoxyethyl, benzyloxy, methoxymethylenemethoxymethyl or t-butoxy), a substituted or unsubstituted cycloalkyl group of 5 to 10 carbon atoms in the ring (such as cyclopentyl, cyclohexyl, cyclooctyl or 4-methylcyclohexyl), a substituted or unsubstituted aryl group of 6 to 10 carbon atoms in the ring (such as phenyl, xylyl, tolyl, naphthyl, p-methoxyphenyl or 4-hydroxyphenyl), or a substituted or unsubstituted heterocyclic group having one or more nitrogen, oxygen or sulfur atoms and a total of 5 to 10 atoms in the ring [such as pyridyl, pyrimidyl, pyrrolyldimethyl, pyrrolyldibutyl, benzothiazolylmethyl, tetrahydroquinolylmethyl, 2-pyridinylmethyl, 4-(N-pyrrolidino) butyl or 2-(N-morpholino)ethyl].

$R_2$ is hydrogen, a substituted or unsubstituted alkyl group of 1 to 12 carbon atoms (as defined above), a substituted or unsubstituted aryl group of 6 to 10 carbon atoms in the ring (as defined above), a substituted or unsubstituted cycloalkyl group of 5 to 10 carbon atoms in the ring (as defined above), a substituted or unsubstituted 5- to 10-membered heterocyclic group having 5 to 10 atoms (as defined above), $—PO_3M_2$ or $—CHR_4PO_3M_2$.

$R_3$ is hydrogen, hydroxyl, a substituted or unsubstituted alkyl group of 1 to 12 carbon atoms (defined above) or $—PO_3M_2$.

$R_4$ is hydrogen, hydroxyl, a substituted or unsubstituted alkyl group of 1 to 12 carbon atoms (as defined above) or $—PO_3M_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups above, useful substituents include, but are not limited to, an alkyl group, hydroxy, sulfo, carbonamido, sulfonamido, sulfamoyl, sulfonato, thialkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_3M_2$, $—CH_2PO_3M_2$ or $—N(CH_2PO_3M_2)_2$ wherein the alkyl (linear or branched) for any of these groups has 1 to 5 carbon atoms.

Representative phosphonic acids useful in the practice of this invention include, but are not limited to the compounds listed in EP 0 428 101A1 (page 4), as well as the following compounds:

ethylenediamine-N,N,N',N'-tetramethylenephosphonic acid, nitrilo-N,N,N-trimethylenephosphonic acid, 1,2-cyclohexanediamine-N,N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N,N-bis (methylenephosphonic acid), 1,3-diamino-2-propanol-N,N,N',N'-tetramethylenephosphonic acid, 1,3-propanediamine-N,N,N',N'-tetramethylenephosphonic acid, 1,6-hexanediamine-N,N,N',N'-tetramethylenephosphonic acid, o-acetamidobenzylamine-N,N-dimethylenephosphonic acid, o-toluidine-N,N-dimethylenephosphonic acid, 2-pyridylmethylamine-N,N-dimethylenephosphonic acid, 1-hydroxyethane-1,1-diphosphonic acid (also known as 1-hydroxyethylidene-1,1-diphosphonic acid), diethylenetriamine-N,N,N',N",N"-penta (methylenephosphonic acid), 1-hydroxy-2-phenylethane-1,1-diphosphonic acid, 2-hydroxyethane-1,1-diphosphonic acid, 1-hydroxyethane-1,1,2-triphosphonic acid, 2-hydroxyethane-1,1,2-triphosphonic acid, ethane-1,1-diphosphonic acid, and ethane-1,2-diphosphonic acid.

Most useful are 1-hydroxyethane-1,1-diphosphonic acid, nitrilo-N,N,N-trimethylenephosphonic acid, diethylenetriamine-N,N,N',N",N"-penta (methylenephosphonic acid), or salts thereof. The first compound is most preferred.

The amount of organic phosphonic acid used in the practice of the invention can be at least about 0.001 mol/l and generally up to about 0.02 mol/l. An amount of from about 0.004 to about 0.012 mol/l is preferred.

Instead of, or in addition to, the phosphonic acids (or salts) described above, the bleaching solution can also contain one or more aminocarboxylic acids (or salts thereof) that contain a tertiary amine. These compounds can be represented by the structure (III):

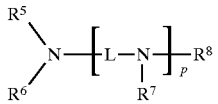

wherein $R^5$, $R^6$, $R^7$ and $R^8$ are independently hydroxyalkyl of 1 to 3 carbon atoms, or carboxyalkyl of 2 to 4 carbon atoms, provided at least one of these groups is carboxyalkyl. The alkyl groups are substituted or unsubstituted and can be branched or linear. The alkyl groups can also be hydroxy-substituted. Preferably, the hydroxyalkyl or carboxyalkyl groups have methyl or ethyl groups.

In structure III, p is 0 or an integer of 1 to 3.

L is a substituted or unsubstituted alkylene group of 2 to 4 carbon atoms (linear or branched, and substituted with hydroxy or carboxy). L can also be a

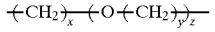

group wherein x and y are independently integers of 2 to 4, and z is an integer of 1 to 3. Moreover, L can be a 6-membered cyclic substituted or unsubstituted alkylene group (optionally substituted with hydroxy or carboxy) or a substituted or unsubstituted arylene group of 6 to 10 carbon atoms in the ring (such as phenylene or naphthylene, optionally substituted with hydroxy or carboxy). Preferably, the compound of structure III has more than one carboxy group.

Representative tertiary aminocarboxylic acids useful in this invention include, but are not limited to, diethylenetriaminepentaacetic acid, and 2-hydroxypropylenediaminetetraacetic acid. The first compound is preferred.

Other addenda commonly added to peroxide bleaching solutions can also be included, such as corrosion inhibitors, optical whitening agents, defoaming agents, calcium sequestrants, peroxide stabilizers, radical scavengers, halogen scavengers, and other materials readily apparent to one skilled in the art.

The color photographic elements to be processed using the present invention can contain any of the conventional silver halide emulsions as the photosensitive material as long as the emulsion contains at least 20 mol % silver bromide, and from 0 to about 0.5 mol % silver iodide. Useful emulsions include those prepared from silver bromide, silver bromoiodide, silver chlorobromide and silver chlorobromoiodide. The amount of silver bromide in such emulsions is preferably from about 25 to 100 mol %. The amount of silver iodide in such emulsions is preferably less than about 0.05 mol %.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerable details of the element structure and components, and suitable methods of processing various types of elements are described in *Research Disclosure*, noted above. All types of emulsions can be used in the elements, including but not limited to, thin tabular grain emulsions.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Color developers are well known and described in hundreds of publications including the *Research Disclosure* noted above. In addition to color developing agents, the color developers generally contain a buffer (such as potassium carbonate), chelating agents, halides, and one or more antioxidants as preservatives. There are many classes of useful antioxidants including, but not limited to, sulfites, hydrazines and substituted or unsubstituted hydroxylamines. By substituted hydroxylamines is meant, for example, those having one or more alkyl or aryl groups connected to the nitrogen atom. These alkyl or aryl groups can be further substituted with one or more groups such as sulfo, carboxy, hydroxy, alkoxy and other groups known in the art which provide solubilizing effects. Examples of such hydroxylamines are described, for example, in U.S. Pat. No. 4,876,174 (Ishikawa et al), U.S. Pat. No. 4,892,804 (Vincent et al), U.S. Pat. No. 5,178,992 (Yoshida et al) and U.S. Pat. No. 5,354,646 (Kobayashi et al).

Development is then followed by the use of a peroxide bleaching solution according to the practice of this invention. The bleaching step can be carried out in any suitable fashion, as is known in the art. Color films, including motion picture print films, can be processed using a wide variety of processing protocols, as described for example, in *Research Disclosure*, noted above, and thus can include various combinations of one or more prebath, developing stop, bleaching, fixing, washing or stabilizing steps in various orders, and lastly, drying.

Bleaching is generally carried out for less than about 60 seconds, but shorter times (such as 30 seconds or less) can be used if desired, depending upon the strength of the bleaching agent and other components in the bleaching solution. No vesiculation is observed after such bleaching times. Bleaching is generally carried out at a temperature that is at or above room temperature, for example from about 25° to about 60° C. and preferably from about 35° to about 40° C.

Processing according to the present invention can be carried out using conventional processing equipment. Alternatively, it can be carried out using what is known in the art as "low volume thin tank" processing systems having either rack and tank or automatic tray designs. Such processing methods and equipment are described, for example, in U.S. Pat. No. 5,436,118 (Carli et al) and publications noted therein.

As used herein, the modifier "about" refers to a variability of ±20% for temperatures, times, ratios and concentrations, and a variation of ±0.5 pH unit in defining pH values.

The following examples are presented to illustrate the practice of this invention, and are not intended to be limiting in any way. Unless otherwise indicated, all percentages are by weight.

EXAMPLES 1–4

Processing of Color Motion Picture Print Films

The present invention was used to process representative color motion picture print films, namely, EASTMAN COLOR PRINT™ Film which contains about 75 mol % silver chloride and 25 mol % silver bromide in the silver halide emulsions. Samples of this film were stepwise exposed at 1/500 second with a HA 50 and 1700 filters, and a 3000K color temperature lamp on a camera-speed sensitometer. The samples were processed at 36.7° C. using the protocol shown below. The bleaching time was varied so as to determine bleaching effectiveness.

| | |
|---|---|
| 10 seconds | Prebath* |
| 20 seconds | Water wash |
| 3 minutes | Development** |
| 40 seconds | Stop solution (1% v/v $H_2SO_4$) |
| 40 seconds | Water wash |
| 0–1 minutes | Bleaching |
| 1 minute | Water wash |
| 40 seconds | Fixing*** |
| 1–2 minutes | Water wash |
| 10 seconds | KODAK PHOTO-FLO ™ rinse |
| 5 minutes | Dry. |

*The prebath solution (per liter) was an aqueous solution of sodium borate, decahydrate (20 g) and sodium sulfate (100 g) and had a pH of 9.25.
**The developing solution (per liter) was an aqueous solution of sodium carbonate (17.1 g), sodium sulfite (4.3 g), sodium bromide (1.7 g), aminotris (methylenephosphonic acid), pentasodium salt (40% w/w, 1 ml) and KODAK ™ Color Developing Agent CD2 (2.95 g), and had a pH of 10.53.
***The fixing solution (per liter) was an aqueous solution of sodium metabisulfite (13 g) and a solution (100 ml) of ammonium thiosulfate (56.5%) and ammonium sulfite (4%), and had a pH of 5. KODAK PHOTO-FLO ™ is a commercially available rinse.

For Example 1, the bleaching solution contained hydrogen peroxide (0.33 mol/l), sodium chloride (0.35 mol/l), sodium carbonate (0.025 mol/l) and sodium bicarbonate (0.025 mol/l), and its pH was adjusted to 10 using sodium hydroxide. Thus, this solution contained no phosphonic acid.

In Example 2, the bleaching solution contained hydrogen peroxide (0.33 mol/l), sodium chloride (0.35 mol/l), sodium carbonate (0.025 mol/l), sodium bicarbonate (0.025 mol/l) and 1-hydroxyethane-1,1-diphosphonic acid (0.004 mol/l), and its pH was adjusted to 10 using sodium hydroxide.

The Control A solution was prepared and used as described in Example 2 of EP-A-0 428 101A1. The solution contained potassium carbonate (21 g/l), potassium bicarbonate (6 g/l), hydrogen peroxide (0.5 mol/l), sodium chloride (0.035 mol/l), and 1-hydroxyethane-1,1-diphosphonic acid (8 g/l), and was adjusted to pH 10 using sodium hydroxide.

Residual silver ($g/m^2$) was determined at maximum density by X-ray fluorescence. The resulting data are provided in Table I below. Bleaching was considered complete when the residual silver level was less than 0.05 $g/m^2$.

TABLE I

| Bleaching Time (seconds) | Example 1 ($g/m^2$) | Example 2 ($g/m^2$) | Control A ($g/m^2$) |
|---|---|---|---|
| 0 | 1.49 | 1.71 | 1.6 |
| 15 | 0.18 | 0.04 | 0.63 |
| 30 | 0.03 | 0.02 | 0.34 |
| 60 | 0.02 | 0.01 | 0.01 |

The data in Table I show that the two peroxide solutions used according to this invention (with and without phosphonic acid) effectively and rapidly (within 30 seconds) bleached the noted photographic elements.

In Examples 3 and 4, similar peroxide bleaching solutions (but with peroxide concentrations of 0.15 mol/l, and 0.57 mol/l, respectively) were effectively used to bleach samples of the same film within 30–60 seconds using the same processing protocol.

It was observed that the Control A solution (containing a lower level of chloride ion than described for this invention) was a slower bleaching solution (over 30 seconds) and produced vesiculation in the film.

It was also observed that the alkaline bleaching solution described herein cannot be used in the conventional EASTMAN COLOR PRINT™ Film process (having a first fixing step) because the first fixing solution (prior to bleaching) poisons the developed silver, causing poor bleaching efficiency by these peroxide bleaches. However, the present invention may be useful in the processing of color print films where the sound tracks are digitally or magnetically recorded since a fixing step is not required prior to bleaching.

EXAMPLE 5

Processing of Motion Picture Films Using Higher Chloride Ion Levels

The processing method described above in Examples 1–4 was used to process imagewise exposed samples of EASTMAN COLOR PRINT™ Film. The bleaching solution contained sodium chloride (see Table II below), hydrogen peroxide (see Table II), sodium carbonate (0.05 mol/l) and 1-hydroxyethane-1,1-diphosphonic acid (0.004 mol/l).

Residual silver ($g/m^2$) was determined at maximum density by conventional X-ray fluorescence techniques after two different bleaching times (30 and 60 seconds). The initial silver coverage was 1.58 $g/m^2$. The data obtained from processing are listed in Table II below. Bleaching was considered complete when the residual silver level was less than 0.05 $g/m^2$.

TABLE II

| | | | | Residual Silver ($g/m^2$) | |
|---|---|---|---|---|---|
| Film Sample | Chloride (mol/l) | Peroxide (mol/l) | pH | 30 sec. | 60 sec. |
| 1 | 0.50 | 0.33 | 10.0 | 0.09 | 0.02 |
| 2 | 0.50 | 0.50 | 10.0 | 0.01 | 0.00 |
| 3 | 0.50 | 0.33 | 10.3 | 0.03 | 0.02 |
| 4 | 0.50 | 0.50 | 10.3 | 0.02 | 0.01 |
| 5 | 1.0 | 0.33 | 10.0 | 0.19 | 0.05 |
| 6 | 1.0 | 1.0 | 10.0 | 0.01 | 0.01 |

TABLE II-continued

| Film Sample | Chloride (mol/l) | Peroxide (mol/l) | pH | Residual Silver ($g/m^2$) 30 sec. | 60 sec. |
|---|---|---|---|---|---|
| 7 | 1.0 | 0.33 | 10.5 | 0.03 | 0.02 |
| 8* | 1.0 | 1.0 | 10.5 | 0.01 | 0.01 |

*Slight vesiculation observed

Comparing the results of Example 2 (above) and the results from samples 1 and 5 of this example, it is seen that increasing the level of chloride ion (above 0.35 mol/l) in the bleaching solution slightly decreases the bleaching rate, but this effect can be overcome by increasing either the amount of peroxide or the pH (for example, samples 2 and 6 for increased peroxide, and samples 3 and 7 for increased pH).

The unexpected advantage of using chloride ion in the bleaching solution at 0.35 mol/l or greater is the suppression of vesiculation. In most cases, there is no observable vesiculation (e.g., compare Control A and Film Sample 2 of Example 5). In some instances, there is slight vesiculation, but considerably less than that expected using conventional bleaching conditions. With routine experimentation, a skilled worker in the art would know what levels of peroxide concentration and chloride ion, and pH values, should be used to obtain the complete suppression of vesiculation while providing rapid bleaching. Conversely, with such understanding, one skilled in the art would know what conditions to avoid because of the occurrence of vesiculation under those conditions. In the case of Film Sample 8 in Table II, it is apparent that the combination of high pH and high peroxide concentration may cause slight vesiculation.

EXAMPLE 6

Processing of Silver Bromide Film

This example illustrates that surprisingly easy bleaching of silver bromide tabular emulsions can be obtained using alkaline peroxide bleaching solutions according to the present invention. This unexpected advantage is achieved even in the presence of a benzotriazole development inhibitor releasing (DIR) coupler.

Four separate photographic elements were prepared, each having a single silver bromide or silver bromoiodide emulsion imaging layer (2.7 g elemental silver/$m^2$) comprising gelatin (6.48 $g/m^2$), a magenta dye forming color coupler (1.08 $g/m^2$) having the structure:

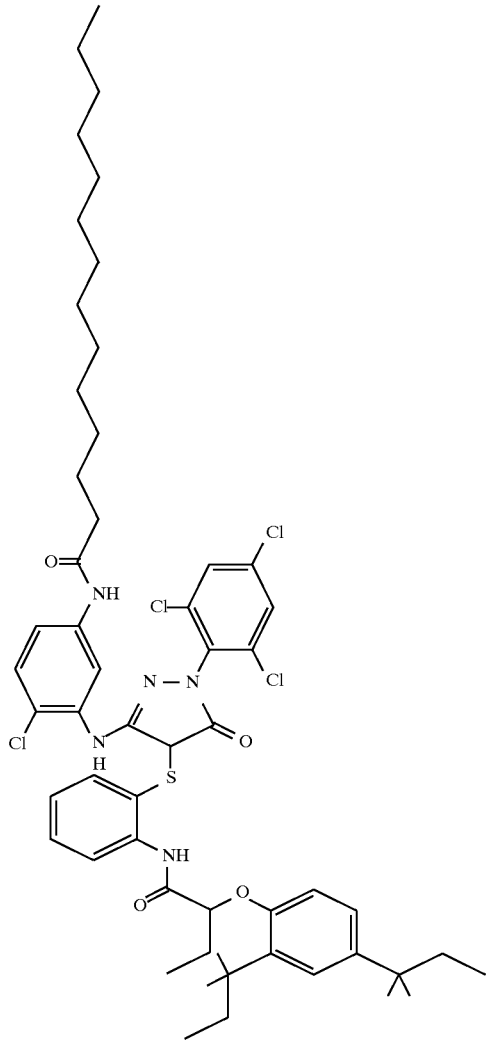

Into the elements were incorporated various amounts of a benzotriazole DIR coupler having the following formula:

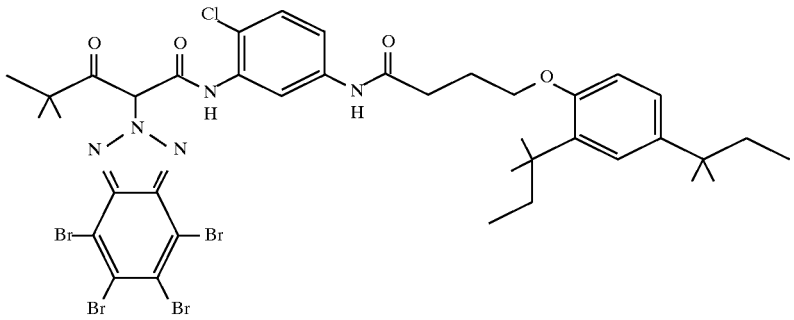

The emulsions differed in halide content, but had similar morphology (<111> tabular), dimensions (1 μm by 0.1 μm), and spectral sensitizations (a 6:1 molar ratio of the compounds having the following structures:

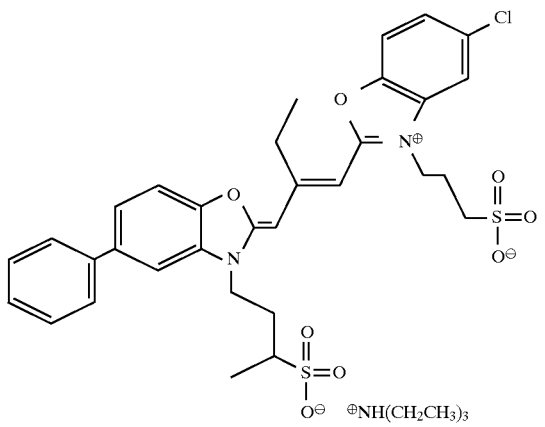

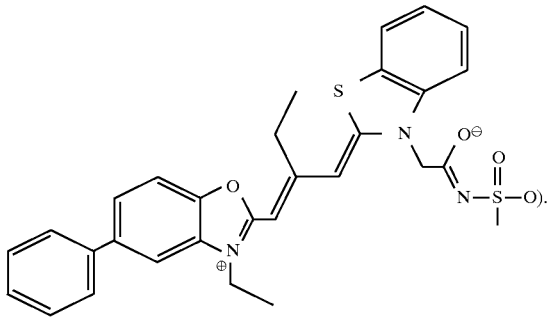

All elements included a gelatin overcoat layer (1.62 g/m$^2$, with 1.75% conventional hardener). The following Table III shows the elements and their emulsion characteristics.

TABLE III

| ELEMENT | EMULSION | DIR COVERAGE (g/m$^2$) |
|---|---|---|
| 1 | AgIBr (4% I$^-$) | 0 |
| 2 | " | 0.054 |
| 3 | AgBr | 0 |
| 4 | " | 0.108 |

Each element was stepwise exposed using conventional techniques and processed at 37.8° C. using the following protocol and processing solutions:

| | |
|---|---|
| Development | 240 seconds |
| Stop bath | 60 seconds |
| Washing | 60 seconds |
| Bleaching | Various times (0–90 sec.) |
| Washing | 180 seconds |
| Fixing | 240 seconds |
| Washing | 180 seconds |
| Rinsing | 60 seconds |
| Drying | |
| Developer Composition: | |
| Water | 800 ml |
| Potassium carbonate | 34.30 g |
| Potassium bicarbonate | 2.32 g |
| Sodium sulfite | 0.38 g |
| Sodium metabisulfite | 2.78 g |
| Potassium iodide | 1.20 mg |
| Sodium bromide | 1.31 g |

-continued

| | |
|---|---|
| Diethylenetriaminepenta-acetic acid, pentasodium salt | 3.37 g |
| Hydroxylamine sulfate | 2.41 g |
| 4-(N-ethyl-N-2-hydroxy-ethyl)-2-methylphenyl-enediamine sulfate | 4.52 g |
| Potassium hydroxide or sulfuric acid | to pH 10.05 |
| Water | to 1 liter |
| Stop bath Composition: | |
| Water | 800 ml |
| Conc. sulfuric acid | 10 ml |
| Water | to 1 liter |
| Bleaching Composition: | |
| Water | 800 ml |
| 30% Aqueous $H_2O_2$ | 100 ml |
| Sodium chloride | 20.45 g |
| 1-Hydroxyethane-1,1-diphosphonic acid | 0.87 g |
| Sodium carbonate | 10.60 g |
| Sodium hydroxide | to pH 10.0 |
| Water | to 1 liter |
| Fixing Composition: | |
| Water | 800 ml |
| Ammonium thiosulfate | 122.3 g |
| Ammonium sulfite | 8.66 g |
| Sodium metabisulfite | 11.85 g |
| Sodium hydroxide (50%) | 2 ml |
| Water | to 1 liter |

After processing, residual silver was measured in each element using the conventional techniques of x-ray fluorescence as described above. Bleaching was considered complete when the silver level was less than 0.1 g/m$^2$. The average developed silver before bleaching was 1.10–1.19 g/m$^2$. The results are presented in Table IV below.

TABLE IV

| BlEACH TIME (sec) | RESIDUAL ELEMENT 1 | SILVER ELE-MENT 2 | (Dmax) ELEMENT 3 | g/m$^2$ ELEMENT 4 |
|---|---|---|---|---|
| 0 | 1.17 | 1.18 | 1.10 | 1.19 |
| 15 | 1.18 | 1.13 | 0.25 | 0.11 |
| 30 | 1.11 | 1.03 | 0.11 | 0.06 |
| 60 | 0.97 | 0.83 | 0.06 | 0.05 |

It is apparent that processing Elements 3 and 4 according to the present invention provided very rapid (less than 60 seconds) bleaching of the AgBr emulsion. It is also apparent that the presence of the DIR coupler (Elements 2 and 4) provided more rapid bleaching than when it was absent. These results are surprising because when DIR couplers are present in amounts necessary for their intended function, they often inhibit bleaching. Thus, it is unusual that the DIR coupler acts both as a development inhibitor and a bleach accelerator when the peroxide bleaching solution is used according to this invention.

The invention has been described in detail with particular reference to preferred embodiments thereof, but it will be understood that variations and modifications can be effected within the spirit and scope of the invention.

We claim:

1. A method for processing a color photographic element comprising:

bleaching an imagewise exposed and developed color photographic film containing a silver halide emulsion having at least 20 mol % silver bromide, and from 0 to 0.5 mol % silver iodide, with a peroxide bleaching solution consisting essentially of:

a peroxide bleaching agent, and chloride ions present in an amount of at least 0.35 mol/l, said bleaching carried out within about 60 seconds.

2. The method of claim 1 wherein said bleaching agent is hydrogen peroxide.

3. The method of claim 1 wherein said bleaching solution comprises said chloride ions in an amount of from 0.35 to about 2 mol/l.

4. The method of claim 3 wherein said bleaching solution comprises said chloride ions in an amount of from 0.35 to about 1.0 mol/l.

5. The method of claim 3 wherein said bleaching solution comprises said chloride ions in an amount of from about 0.5 to about 1.0 mol/l.

6. The method of claim 1 wherein said bleaching solution has a pH of from about 9 to about 11.

7. The method of claim 1 wherein said bleaching solution further comprises an organic phosphonic acid or salt thereof having the structure (I):

$$R_1N(CH_2PO_3M_2)_2$$

or the structure (II):

$$R_2R_3C(PO_3M_2)_2$$

wherein $R_1$ is hydrogen, an alkyl group of 1 to 12 carbon atoms, an alkylaminoalkylene group wherein each alkyl or alkylene group has 1 to 12 carbon atoms, an alkoxyalkyl group of 1 to 12 carbon atoms, an aryl group of 6 to 10 carbon atoms in the ring, a cycloalkyl group of 5 to 10 carbon atoms in the ring, or a heterocyclic group having 5 to 10 atoms in the ring, $R_2$ is hydrogen, an alkyl group of 1 to 12 carbon atoms, an aryl group of 6 to 10 carbon atoms in the ring, a cycloalkyl group of 5 to 10 carbon atoms in the ring, a heterocyclic group having 5 to 10 atoms in the ring, —$PO_3M_2$ or —$CHR_4PO_3M_2$, $R_3$ is hydrogen, hydroxyl, an alkyl group of 1 to 12 carbon atoms or —$PO_3M_2$, $R_4$ is hydrogen, hydroxyl, an alkyl group of 1 to 12 carbon atoms or —$PO_3M_2$, and M is hydrogen or a monovalent cation; or a tertiary aminocarboxylic acid having the structure (III)

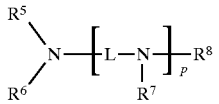

wherein $R^5$, $R^6$, $R^7$ and $R^8$ are independently a hydroxyalkyl group or a carboxyalkyl group, provided at least one of them is a carboxyalkyl group, p is 0, 1, 2 or 3, L is an alkylene group, a $$-(CH_2)_x-(O-(CH_2)_y)_z-$$

group, a cyclic alkylene group having 6 carbon atoms in the ring, or an arylene group having 6 to 10 carbon atoms in the ring, x and y are independently integers of 2 to 4, and z is an integer of 1 to 3.

8. The method of claim 7 wherein said organic phosphonic acid or salt thereof is 1-hydroxyethane-1,1-diphosphonic acid, nitrilo-N,N,N-trimethylenephosphonic acid or diethylenetriamine-N,N,N',N",N"-penta (methylenephosphonic acid), and said tertiary aminocarboxylic acid is diethylenetriaminepentaacetic acid or 2-hydroxypropylenediaminetetraacetic acid.

9. The method of claim 7 wherein said organic phosphonic acid or salt thereof, or tertiary aminocarboxylic acid or salt thereof, is present in an amount of from about 0.001 to about 0.02 mol/l.

10. The method of claim 9 wherein said organic phosphonic acid or salt thereof, or tertiary aminocarboxylic acid or salt thereof, is present in an amount of from about 0.004 to about 0.012 mol/l.

11. The method of claim 1 wherein said bleaching agent is present in said bleaching solution in an amount of at least about 0.15 mol/l.

12. The method of claim 11 wherein said bleaching agent is present in said bleaching solution in an amount of from about 0.15 to about 1 mol/l.

13. The method of claim 1 wherein said bleaching is accomplished within about 30 seconds.

14. The method of claim 1 wherein said silver halide emulsion has less than about 0.05 mol % silver iodide.

15. The method of claim 1 wherein said silver halide emulsion has from about 25 to 100 mol % silver bromide.

16. The method of claim 15 wherein said silver halide emulsion has from about 95 to 100 mol % silver bromide.

17. The method of claim 1 wherein said bleaching solution has a pH of from about 9.5 to about 10.5.

18. The method of claim 1 wherein said bleaching agent is hydrogen peroxide that is present in said bleaching solution in an amount of from about 0.35 to about 0.5 mol/l.

19. The method of claim 1 wherein said color photographic film is a color motion picture print film.

* * * * *

UNITED STATES PATENT AND TRADEMARK OFFICE

CERTIFICATE OF CORRECTION

PATENT NO. : 5,773,202

DATED : June 30, 1998

INVENTOR(S) : Shirleyanne E. Haye, et. al.

It is certified that error appears in the above-identified patent and that said Letters Patent is hereby corrected as shown below:

Title page, item [76] after "Shirleyanne E. Haye" insert --Rochester--, after "Terrence R. O'Toole" insert --Webster--, after "David L. Cole" insert --Rochester-- and after "John M. Buchanan" insert --Rochester, all of New York--.

Signed and Sealed this

Fifteenth Day of December, 1998

Bruce Lehman

*Attest:*

BRUCE LEHMAN

*Attesting Officer*

*Commissioner of Patents and Trademarks*